US009494377B2

(12) United States Patent
Lee et al.

(10) Patent No.: US 9,494,377 B2
(45) Date of Patent: Nov. 15, 2016

(54) HANDHELD FIREARM CHAMBERING DEVICE

(71) Applicants: John Lee, San Antonio, TX (US); Nancy Keyes Lee, San Antonio, TX (US)

(72) Inventors: John Lee, San Antonio, TX (US); Nancy Keyes Lee, San Antonio, TX (US)

( * ) Notice: Subject to any disclaimer, the term of this patent is extended or adjusted under 35 U.S.C. 154(b) by 0 days.

(21) Appl. No.: 14/468,921

(22) Filed: Aug. 26, 2014

(65) Prior Publication Data

US 2015/0300776 A1 Oct. 22, 2015

Related U.S. Application Data

(60) Provisional application No. 61/869,998, filed on Aug. 26, 2013.

(51) Int. Cl.
*F41A 35/00* (2006.01)
*F41A 9/38* (2006.01)

(52) U.S. Cl.
CPC . *F41A 35/00* (2013.01); *F41A 9/38* (2013.01)

(58) Field of Classification Search
CPC ..... F41C 27/00; F41C 3/00; F41A 3/72; F41A 7/00; F41A 19/52; F41A 35/00; F41A 19/39; F41A 21/32; F41A 9/38
See application file for complete search history.

(56) References Cited

U.S. PATENT DOCUMENTS

| | | | | |
|---|---|---|---|---|
| 2,356,538 | A * | 8/1944 | Schmeisser | 42/106 |
| 5,438,907 | A * | 8/1995 | Reynolds et al. | 89/14.5 |
| 7,298,274 | B2 * | 11/2007 | Chen | G09F 3/0376 29/282 |
| 7,942,090 | B1 * | 5/2011 | Hoffman | 89/29 |
| 9,157,691 | B2 * | 10/2015 | Parnell | F41A 7/00 |

* cited by examiner

*Primary Examiner* — Stephen M Johnson
*Assistant Examiner* — Joshua Semick
(74) *Attorney, Agent, or Firm* — Global Intellectual Property Agency, LLC; Daniel Boudwin

(57) ABSTRACT

Disclosed is a handheld firearm chambering device suitable for use with semi-automatic handguns and the like having a movable slide. The device comprises an elongated sleeve member having an open interior supporting a center guide element therein. The center guide element is coaxially disposed within the sleeve and comprises a base portion and an extended muzzle plunger portion, wherein the plunger portion preferably extends beyond the working end of the sleeve. The device is held within the non-dominate hand of the user and utilized to press the slide rearward along the barrel without using a grip-and-squeeze method. The working end of the sleeve bears against the end of the slide as the center guide element is accepted through the muzzle end of the firearm. A pressing motion moves the slide and chambers a round, where minimal grip strength is required to accomplish this task.

3 Claims, 3 Drawing Sheets

HANDHELD FIREARM CHAMBERING DEVICE

CROSS REFERENCE TO RELATED APPLICATION

This application claims the benefit of U.S. Provisional Application No. 61/869,998 filed on Aug. 26, 2013. The above identified patent application is herein incorporated by reference in its entirety to provide continuity of disclosure.

BACKGROUND OF THE INVENTION

Field of the Invention

The present invention relates to a handgun chambering device and handheld assistant. More specifically, the present invention relates to a chambering device that a user can press against the slide of a handgun from the end of the barrel to chamber a round using a pushing action rather than a grip-and-pull action.

Most modern handguns and pistols are designed using a semi-automatic reloading assembly. These handguns generally comprise a handle that supports a cartridge of firearm rounds in a substantially vertical stack, along with a barrel that is adapted to accept one round at a time into the chamber and reload a subsequent round into the chamber after the first is fired. After the first round, the energy from the round is used as an input for a recoil mechanism, which ejects the spent casing of the round and allows another round to be chambered from the cartridge within the handle. This allows the user to fire one round after another without manually loading each bullet in the barrel of the firearm.

The recoil mechanism is generally a slide that is spring mounted to the frame of the pistol, whereby the energy from a fired bullet forces the slide rearward against the recoil spring to an extent the casing is ejected and another round can move upwards to take its place. This general reloading operation is well known in the art, with different adaptations and designs for different manufacturers. While this design is very useful for firing one round after another, the first round that is placed into the chamber must be done manually. To wit, the slide must be drawn rearward by the user or the slide must be positioned in a locked, rearward position and thereafter released to chamber the first round of a new cartridge. In the first instance, the user must grip the rear of the slide and pull the slide rearward to replicate the reloading operation that is normally accomplished by the last fired round.

While the operation of chambering a first round into the barrel of a handgun is well known and understood in the art, not all users have the grip strength or dexterity to accomplish this task. This can prevent some individuals from purchasing this style of weapon or make it difficult to chamber. As a result, many may purchase a revolver style handgun or simply struggle to chamber a round of a semi-automatic handgun at a firing range. The latter situation can be dangerous for the user and to others, as well as a hindrance to the user when the handgun is to be used. The present invention is presented as a means of chambering a first round in a semi-automatic handgun, whereby the grip-and-pull motion is replaced by a two-handed pressing motion that requires less grip strength.

Specifically, the present invention provides a simple hand tool that is adapted to engage the slide and barrel of a handgun and be used to depress the slide rearward against the recoil spring to chamber a round therein. The device comprises an elongated handheld member that is adapted to be operated by the non-dominant shooting hand of the user and fit within the palm portion thereof. The device comprises an open sleeve member that supports an elongated center guide element therein. The center guide is positioned within the open end of the barrel (i.e. the muzzle) and pressed thereinto, while the flange of the working end of the sleeve member presses against the distal end of the slide to force it rearward against the recoil spring. This exposes the ejection port and allows the next round within the cartridge to be forced into the chamber via the spring biased clip in the handle. The user holds the hand tool with one hand and supports the firearm in the opposite hand, thereby allowing the cocking motion to be accomplished using a pressing motion between the hands of a user, rather than a pulling motion that requires grip strength. Alternatively, the hand tool can be mounted to a support and the user can chamber a round using one hand, whereby the handgun muzzle is pressed against the statically-mounted tool.

Description of the Prior Art

Devices have been disclosed in the prior art that related to handgun chambering and cocking devices. These include devices that have been patented and published in patent applications. These devices generally relate to devices attached to the slide or those that require a pulling action by the user. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 8,015,741 to Hooks, which discloses a device for pulling the slide of a handgun, which comprises a slide pull releasably coupled to the rear end of the slide and along opposite sides thereof. The slide comprises a U-shaped member that can be grasped and pulled rearward, causing the slide to articulate and to chamber a round into the handgun. Further provided on the Hooks device is a trigger restraint, wherein the assembly is positionable as either a trigger restraint or a slide pull device. While providing a means to chamber a round, the Hooks device requires the user to pull on the handgun. The purpose of the present invention is to eliminate pulling motion, which is difficult for some. The present invention contemplates a pushing motion, wherein a tool is used to force the slide backwards as the handgun is held between the user's hands. Compressing action of the tool against the slide causes the slide to move rearward.

Another device is U.S. Pat. No. 6,561,073 to Høgmoe, which discloses a device that allows a user to draw, load, and cock a firearm with one continuous movement, whereby a first element is disposed along the slide and a second element is fixed thereto until enough force is applied to break the connection. A spring element is used to fix the two elements together, whereby the second element maintains is hold on the first element to cock the firearm as it is drawn, and thereafter releases the firearm when the user places sufficient force through the joint to release the connection. The Høgmoe is one that assists cocking and drawing of a firearm in one motion, wherein that motion is a pushing motion. However, the structure and the motion required to chamber a firearm with the Høgmoe device diverges significantly from the present invention. The present invention contemplates a device that secures within the barrel end of the firearm and presses the slide backwards therefrom to chamber a round. It is not designed to be used while drawing the weapon, but rather afford those with limited grip strength the ability to chamber a round using a compressive, pressing motion rather than a grip-and-pull motion.

U.S. Patent Publication No. 2011/0283587 to Sharp discloses yet another device for cocking a firearm, wherein at least one cam lock is used to engage a firearm slide. A pair of cam locks engages the slide from the sides as the slide is placed therebetween. The cam locks engage the slide as the user moves the firearm therethrough. This causes the slide to remain relatively stationary as the firearm is advanced, thereby chambering a round. Similar to the Hogmoe device, the Sharp device is one that proposes a more sophisticated structure than what is desired herein. The present invention utilizes a barrel-engaging hand tool that can be pressed against the end of the barrel. The tool engages the end of the slide and forces it rearward without clashing with the barrel. This chambers a round without requiring a pulling motion.

U.S. Pat. No. 8,191,301 to Hatfield discloses an attachment for the slide of a firearm, whereby the attachment comprises a pair of lateral arms disposed along the proximal end of the slide. The device forms a U-shaped assembly having a flange portion along the interior thereof to engage the slide and sandwich it between the flange and the arms. While providing an assembly that engages the slide to increase its area along the proximal end, the Hatfield device relies on a pulling motion by the user. This motion teaches away from the present invention, which contemplates a pressing motion from the opposite end of the slide.

Finally, U.S. Pat. No. 5,955,696 to Meller discloses a firearm assembly that allows the slide to be decoupled from the recoil spring when chambering a round therein, whereby the return force applied by the recoil spring is bypassed and the user can more easily draw the slide backwards to chamber a round. The device is capable of moving the slide from a coupled position to a decoupled position with respect to the spring, thus removing any bias thereon for easy sliding. The Meller device, while providing a unique means of assisting the cocking motion, also discloses a structure not contemplated by and not anticipating the present invention.

The present invention comprises a hand tool operated by the user's non-dominate hand, whereby the device is pressed into the muzzle of the handgun to engage the slide and to allow a compressive motion between the user's hands to draw the slide rearward. This allows a round to be chambered within the handgun without requiring a grip-and-pull operation, which may be difficult for some. An alternative configuration is mounting the hand tool to an external static support and using one hand to engage the tool into the handgun muzzle. It is submitted that the present invention is substantially divergent in design elements from the prior art, and consequently it is clear that there is a need in the art for an improvement to existing handgun chambering devices. In this regard the instant invention substantially fulfills these needs.

SUMMARY OF THE INVENTION

In view of the foregoing disadvantages inherent in the known types of handgun chambering now present in the prior art, the present invention provides a new chambering hand tool wherein the same can be utilized for providing convenience for the user when chambering a round within a semi-automatic pistol without gripping the slide thereof.

It is therefore an object of the present invention to provide a new and improved handgun chambering device that has all of the advantages of the prior art and none of the disadvantages.

It is another object of the present invention to provide a handgun chambering device that replaces a grip-and-pull method for chambering a semi-automatic handgun with a pressing motion between the two hands of the user, whereby minimal grip strength is required.

Another object of the present invention is to provide a handgun chambering device that is used within the non-dominate (non-shooting) hand and used to press the slide of the handgun rearward against its recoil spring.

Yet another object of the present invention is to provide a handgun chambering device that is comprised of a simple construction and one that can be used with minimal training.

Another object of the present invention is to provide a handgun chambering device that is embodied in a simple, handheld tool that can be body-carried in a pocket or disposed on a lanyard between uses.

Another object of the present invention is to provide a handgun chambering device that has no moving parts and does not require modification of the handgun or attachment thereto.

A final object of the present invention is to provide a handgun chambering device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
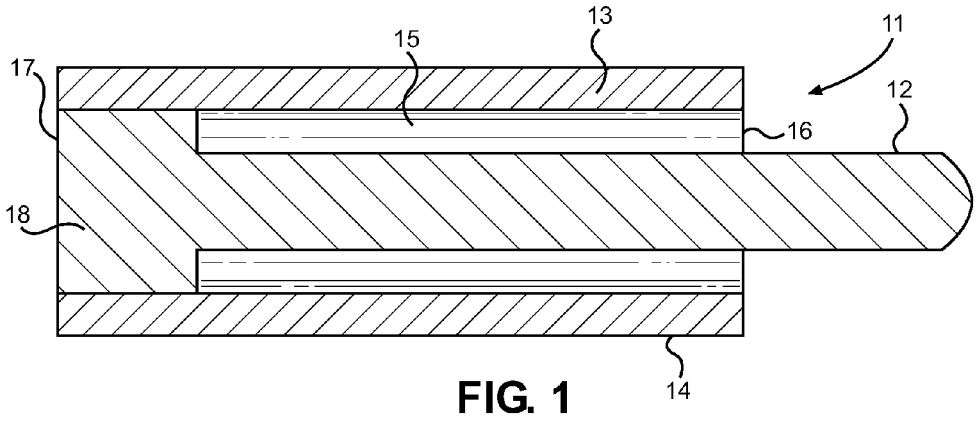
FIG. 1 shows a cross section view of the firearm chambering device of the present invention.

Reference is made herein to the attached drawings. Like reference numerals are used throughout the drawings to depict like or similar elements of the firearm chambering device of the present invention. For the purposes of presenting a brief and clear description of the present invention, the preferred embodiment will be discussed as used for chambering a round within a firearm without using a grip-and-pull method and using a handheld press tool. The figures are intended for representative purposes only and should not be considered to be limiting in any respect.

Referring now to FIG. 1, there is shown a cross section view of the firearm chambering device 11 of the present invention. The device 11 is a handheld tool that is used to force the slide of a handgun rearward and against its coil spring, thereby opening the chamber to eject a cartridge and/or chamber a new round. The device is adapted to be held by the non-dominate (or non-shooting) hand of the user or be supported by a static support, whereby in either embodiment the tool is placed against the distal end of the slide. Once in position, the user can press the device 11 against the firearm to move the slide rearward and chamber the next round. The goal is to eliminate the grip-and-pull method that is normally used, which requires a degree of grip strength and dexterity that some users may no longer have available.

The construction of the firearm chambering device 11 includes an elongated sleeve member with an open interior 15 and a perimeter sidewall 13. The sidewalls 13 comprises an outer surface 14 and an inner surface, whereby the inner surface and the open interior is adapted to receive the muzzle end of the handgun barrel therein. The sleeve member further comprises a working end 16 and a rear end 17, whereby the working end 16 is adapted and sized to bear against the distal end of the firearm slide while the open interior accepts the muzzle end of the barrel therethrough. The inner surface of the sleeve member is preferably rounded, while the outer surface 14 of the sleeve member may be rounded or shaped to improve grip on the exterior surface of the device while in use.

Disposed within the interior 15 of the sleeve member is a center guide element. The center guide element is an elongated structure adapted to be inserted into the muzzle end of the firearm barrel and align the sleeve with the barrel while in action. The center guide comprises a base portion 18 and an extended muzzle plunger portion 12. The plunger portion 12 preferably extends outward from the working end 16 of the sleeve member to facilitate alignment of the sleeve working end 16 with the slide, and further to ensure the device 11 is concentrically and coaxially aligned with the barrel of the firearm.

Figure 2:
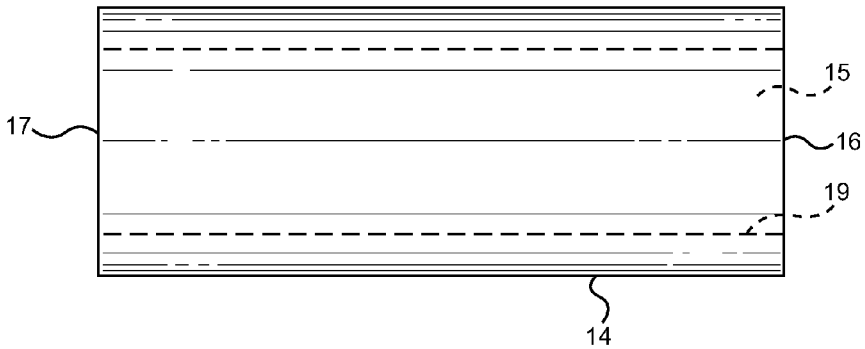
FIG. 2 shows a side view of the sleeve member of the present invention.

Referring now to FIG. 2, there is shown a side view of the sleeve member of the present invention. In this embodiment, the exterior surface 14 of the sleeve member is rounded and the sleeve comprises an open, cylindrical shape with an open rear end 17 and an open working end 16. In use, the user supports the outer surface 14 of the device and presses the working end 16 against the slide, eliminating the need to grip and pull the slide from its rear slide grips. The muzzle end of the firearm is positioned within the open interior 15 of the sleeve and the inner surface 19 thereof provides sufficient clearance so as not to clash or interfere with the outer surface of the barrel when inserted therethrough.

Figure 3:
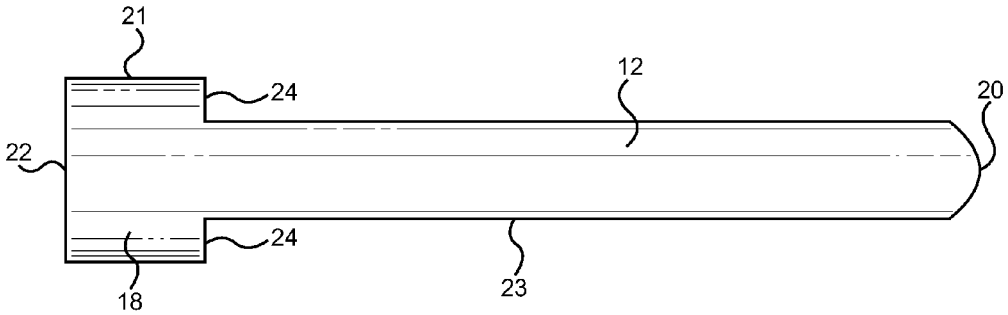
FIG. 3 shows a side view of the center guide element of the present invention.

Referring now to FIG. 3, there is shown a side view of the center guide element of the present invention. The center guide element comprises a base portion 18 and an elongated plunger portion 12. The base portion 18 is adapted to be supported by the sleeve member along the rear end thereof and within its open interior. The base portion 18 comprises a shape and an outer surface profile 21 such that the profile matches the inner surface of the sleeve and can be bonded, fastened, or otherwise secured within the interior of the sleeve member. The base portion 18 and the sleeve member are preferably statically affixed to one another and not separable after assembly.

The base portion 18 comprises a rear surface 22 and shelf portion 24. The shelf portion 24 surrounds the elongated plunger portion 12 and acts as a stop within the interior of the sleeve portion. The plunger portion 12 comprises an elongated member having a rounded outer surface 23 and a distal end 20 disposed within or extended outward from the open interior of the sleeve member. As provided in FIG. 1, the plunger member distal end 20 is positioned outside of the sleeve member and facilitates alignment of the sleeve with the muzzle, wherein the plunger member 12 is adapted to be inserted into the muzzle of the firearm and used as a guide as the sleeve member is advanced and pressed against the slide. The diameter of the plunger 12 may take on different sizes, however it is contemplated that a size suitable for use with smaller caliber firearms be utilized, as the smaller size can equally function with larger caliber firearms, albeit with greater clearance between the plunger and the barrel.

Figure 4:
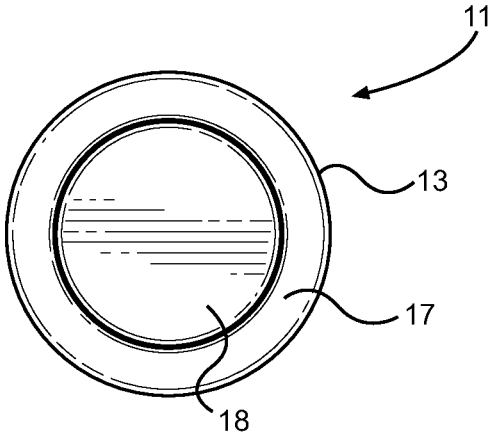
FIG. 4 shows an end view of the assembled device from the rear end thereof.
Figure 5:
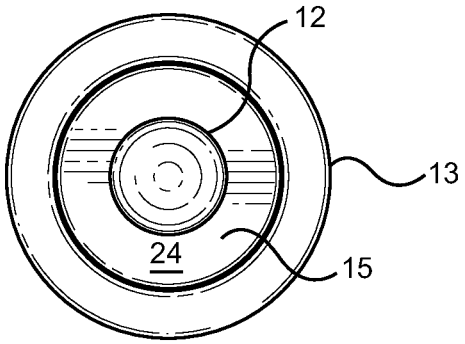
FIG. 5 shows an end view of the assembled device from the working end thereof.

Referring now to FIGS. 4 and 5, there are shown end views of the firearm chambering device 11 of the present invention. FIG. 4 illustrates the rear end of the device when assembled, wherein the rounded sleeve member is coaxial with the base portion 18 of the center guide element. The rear end 17 of the sleeve aligns with the base portion 18 at its rear surface, or alternative the rear end of the sleeve encloses or partially encloses the rear surface of the base portion (not shown).

Several constructions are contemplated, including bonding the base portion 18 to the sleeve member, providing a tab or ledge along the rear end 17 of the sleeve to prevent relative movement between the two, or other constructions in which the base portion 18 and the sleeve are statically joined in a coaxial relationship. Furthermore, the outer surface profile 13 of the sleeve member may also be deployed with various shapes, outer surface profiles, and configurations to suit the needs of the user. These include having hand grip projections, providing an outer surface profile that is not completely rounded, and the like. The sleeve comprises a member that supports the center guide element and provides a working end that can bear against the slide. The sidewall of the sleeve member need only fit between the exposed barrel and frame of the firearm, which generally comprises a small clearance.

Referring specifically to FIG. 5, the working end of the firearm chambering device 11 of the present invention is shown. The working end of the device is used to bear against the distal end of the slide, which is pressed rearward relative to the muzzle to open the ejection port of the firearm and chamber a round from the clip positioned within the grip of the firearm. The muzzle of the barrel is positioned between the sleeve sidewall 13 and the plunger member 12 disposed therein. The user presses the sleeve against the slide, advancing the plunger member 12 into the muzzle and pressing the slide rearward against is recoil spring. The shelf portion 24 of the center guide element provides a stop that the muzzle may bear against; however this is generally disposed a sufficient distance within the interior 15 of the device such that the rear-most extend of the slide travel will be reached before the muzzle bears against the shelf portion 24. The shelf portion 24 is positioned in close proximity to the rear end of the sleeve to prevent interference with the muzzle while advancing the sleeve over the barrel.

The plunger member 12 is coaxial with the sleeve member and centrally disposed within its open interior. For embodiments in which the sidewall of the sleeve member is cylindrical, the base portion plunger member 12 is concentrically mounted therein. Preferably, the inner surface of the sleeve member comprises a rounded profile that is concentric with the outer profile of the plunger member 12, wherein the two share the same central axis and are offset from one another a sufficient distance to allow the barrel of a firearm to be positioned therebetween while the working end of the sleeve bears against the firearm slide.

Figure 6:
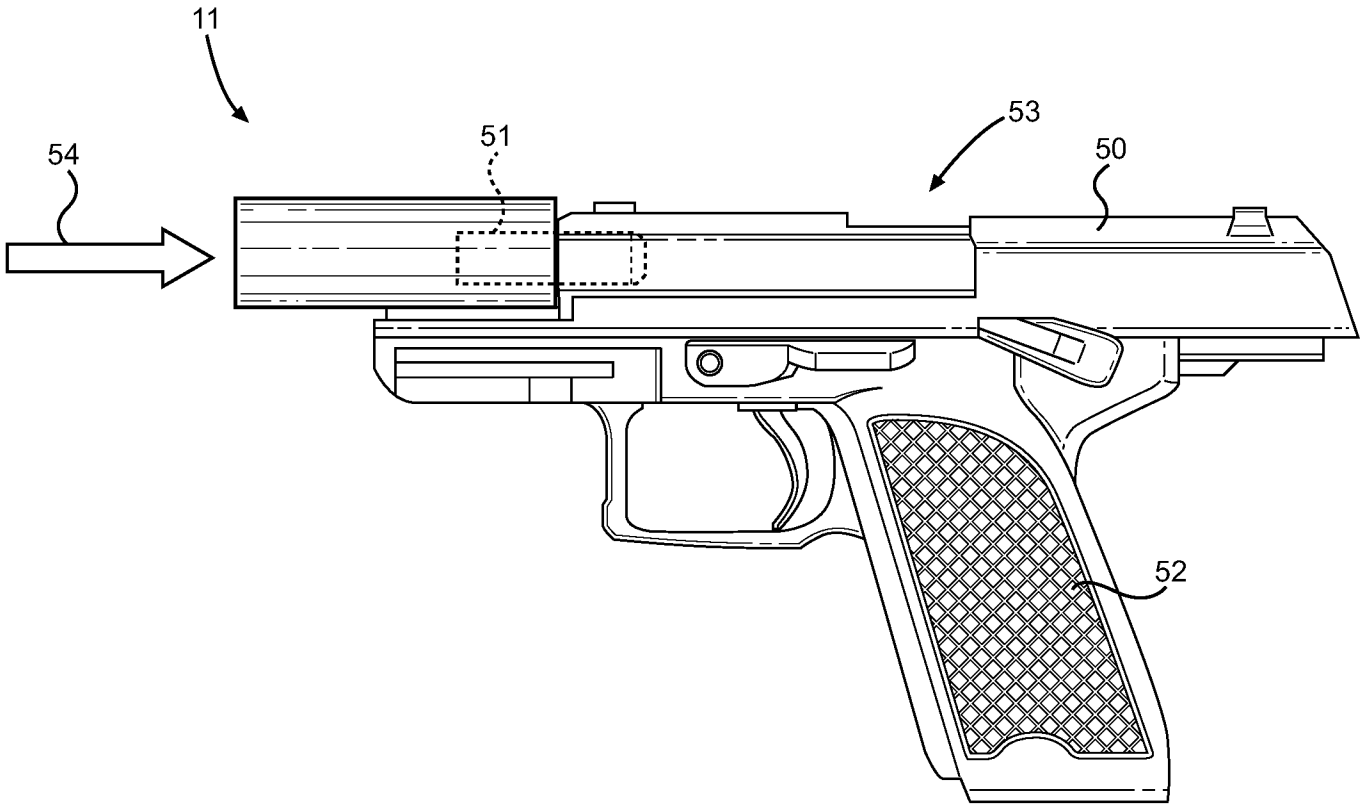
FIG. 6 shows an illustrative view of the firearm chambering device in a working state with a semi-automatic handgun.

Referring finally to FIG. 6, there is shown a view of the firearm chambering device 11 in a working state, pressing the slide 50 of the firearm rearward and against its recoil spring. In operation, the user grips the firearm as he or she would naturally, whereby the user's shooting hand is holding the firearm from the grip portion 52 thereof. The user supports the chambering device 11 from either the non-shooting hand or from an external support, aligning the working end of the device 11 with the barrel 51 and distal end of the slide 50. The center guide element is positioned within the interior of the barrel 51 and through its open muzzle, whereafter the user presses the device 11 against the distal end of the slide 50 as the user supports the firearm from the grip. This causes the slide 50 to translate rearward 54, exposing the ejection port 53 such that a round can be removed and/or another round within the clip disposed in the grip 52 can advance upward and be chambered within the barrel.

As shown, the thickness and design of the sleeve sidewall must fit between the exposed barrel 51 and the frame of the firearm to operate correctly and allow the sleeve to remain in contact with the slide 50 throughout its allowable travel. When deployed, the device 11 offers a user the ability to easily and readily chamber a round without gripping the slide directly and pulling it rearward, but rather to press the slide rearward using a pushing motion instead. Between uses, the device 11 can be stowed either on the user's body (e.g. in a pocket or suspended from a lanyard), or the device can be placed aside for subsequent use (e.g. along a ledge at a shooting range, et al.).

An alternative configuration of the present invention is supporting the hand tool using a static support, such as against a flat surface or by using an attachment bracket or the like. In this alternative, the user does not have to handle the tool, but rather can chamber a round with only one hand. Specifically, the user can support the firearm in one hand along its grip, align the muzzle with the hand tool and press the handgun thereagainst to actuate the slide. This accomplishes the same goal, but requires only one hand to actuate the slide. This embodiment is contemplated for those with reduced grip strength, users having a handicap or missing appendage, or in environments that would suit this installation (e.g. firing ranges, etc.).

Many individuals do not have enough arm and wrist strength to operate the slide spring on semi-automatic handguns. Unfortunately, this factor can prevent individuals from purchasing semi-automatic weapons or discourage their use at shooting ranges. Many users struggle to cock and chamber a round in such types of firearms, which is frustrating, inconvenient, and potentially dangerous. The present invention is provided as a deployable hand tool for semi-automatic handguns, whereby the user is not required to grip or pull on the slide to chamber a round. The device includes an apparatus that fits in the palm of the non-dominant, non-shooting hand, and is adapted to be inserted into the muzzle of the firearm to compress the recoil spring and expose the ejection port thereof. The assembly may be constructed of a plastic or other suitable material that has sufficient strength and stability to activate the slide and compress the recoil spring thereof. Overall, the device minimizes pressure on the hands and wrists for maximum convenience. The device saves time when cocking and firing the handgun in critical situations. Furthermore, the device benefits people with limited strength in their hands and wrists.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of translating the slide of a firearm rearward, comprising the steps of:

supporting a firearm having a slide portion and a barrel;

supporting a handheld chambering device having an elongated sleeve member and a center guide element;

aligning said center guide element with said barrel;

inserting said center guide element into said barrel;

pressing said elongated sleeve member against said slide to effectuate a rearward translation of said slide to expose an ejection port along said firearm.

2. The method of claim 1, wherein:

said step of supporting a firearm having a slide portion an a barrel is conducted using a first hand; and said step of supporting a handheld chambering device having an elongated sleeve member and a center guide element is conducted with a second hand.

3. The method of claim 1, wherein:

said step of supporting a firearm having a slide portion an a barrel is conducted using a first hand; and said step of supporting a handheld chambering device having an elongated sleeve member and a center guide element is accomplished using an external support.

* * * * *